US009068336B2

(12) United States Patent
Shaw

(10) Patent No.: US 9,068,336 B2
(45) Date of Patent: Jun. 30, 2015

(54) REINFORCED TRANSPARENT DRAIN SEAL

(71) Applicant: Mark D. Shaw, Ponte Vedra Beach, FL (US)

(72) Inventor: Mark D. Shaw, Ponte Vedra Beach, FL (US)

( * ) Notice: Subject to any disclaimer, the term of this patent is extended or adjusted under 35 U.S.C. 154(b) by 0 days.

(21) Appl. No.: 14/154,919

(22) Filed: Jan. 14, 2014

(65) Prior Publication Data

US 2014/0197604 A1 Jul. 17, 2014

Related U.S. Application Data

(60) Provisional application No. 61/752,641, filed on Jan. 15, 2013.

(51) Int. Cl.
*E03F 5/04* (2006.01)

(52) U.S. Cl.
CPC ..... *E03F 5/0411* (2013.01)

(58) Field of Classification Search
CPC ..... E03F 5/0411
USPC ..... 52/204.5, 209, 204.52
See application file for complete search history.

(56) References Cited

U.S. PATENT DOCUMENTS

| | | | | | |
|---|---|---|---|---|---|
| 3,445,973 | A * | 5/1969 | Stone | 4/295 |
| 3,474,625 | A * | 10/1969 | Bennett et al. | 405/270 |
| 4,765,775 | A * | 8/1988 | Kroger | 405/52 |
| 4,776,722 | A * | 10/1988 | Gaudin | 404/25 |
| 4,838,732 | A * | 6/1989 | Clark et al. | 405/52 |
| 4,981,391 | A * | 1/1991 | Klementovich | 405/52 |
| 4,988,234 | A * | 1/1991 | Henkel et al. | 405/36 |
| 6,338,168 | B1 * | 1/2002 | Valentine | 4/293 |
| 6,530,722 | B1 * | 3/2003 | Shaw et al. | 405/52 |
| 7,879,233 | B2 * | 2/2011 | Shaw et al. | 210/164 |
| 7,887,257 | B2 * | 2/2011 | Shaw et al. | 405/52 |
| 7,950,075 | B2 * | 5/2011 | Evans et al. | 4/293 |
| 8,117,686 | B2 * | 2/2012 | Powell et al. | 4/293 |
| 8,230,530 | B2 * | 7/2012 | Evans et al. | 4/293 |
| 8,679,328 | B2 * | 3/2014 | Hebert | 210/163 |
| 2004/0157074 | A1 * | 8/2004 | Hubbard | 428/515 |
| 2004/0237180 | A1 * | 12/2004 | Evans et al. | 4/293 |
| 2005/0170143 | A1 * | 8/2005 | Yau | 428/141 |
| 2005/0262624 | A1 * | 12/2005 | Evans et al. | 4/293 |
| 2007/0033722 | A1 * | 2/2007 | Evans et al. | 4/293 |
| 2011/0219527 | A1 * | 9/2011 | Evans et al. | 4/293 |
| 2014/0144067 | A1 * | 5/2014 | Shefer | 43/132.1 |
| 2014/0197604 | A1 * | 7/2014 | Shaw | 277/626 |

* cited by examiner

*Primary Examiner* — Mark Wendell
*Assistant Examiner* — Keith Minter
(74) *Attorney, Agent, or Firm* — Thomas C. Saitta

(57) ABSTRACT

A mat-like drain seal composed of a flexible, compressible, conformable polymer material and having at least a centralized window area and a reinforcing band positioned adjacent the edges of the drain seal, the window area being at least translucent such that liquid passing under the drain seal is visible through the drain seal.

8 Claims, 1 Drawing Sheet

FIG. 1
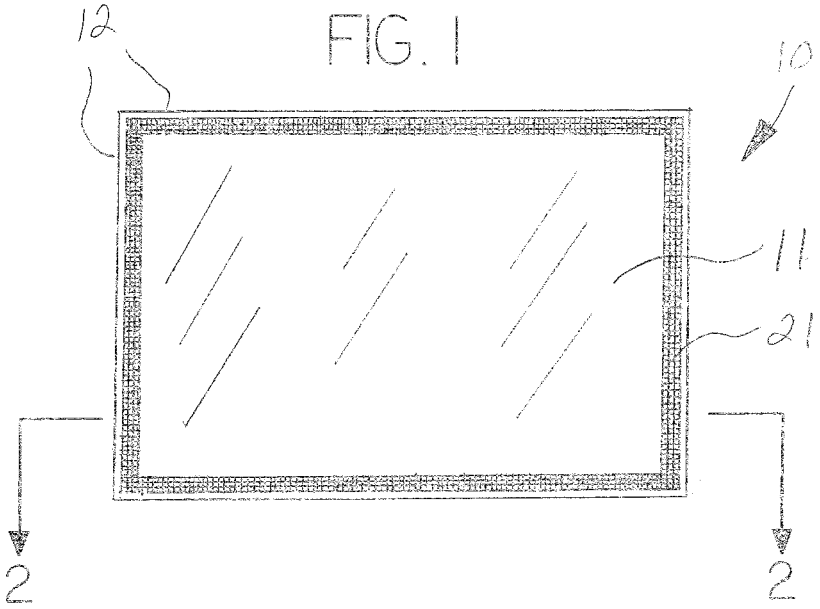
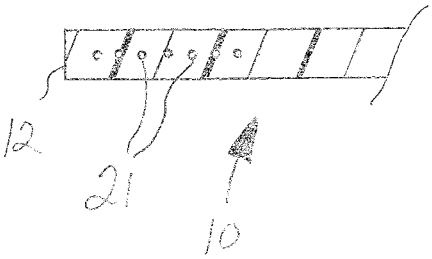
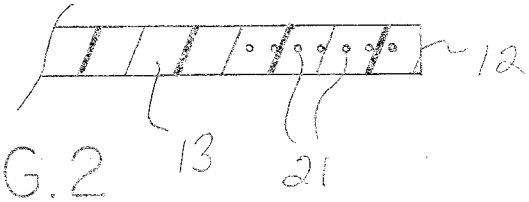
FIG. 2
FIG. 3
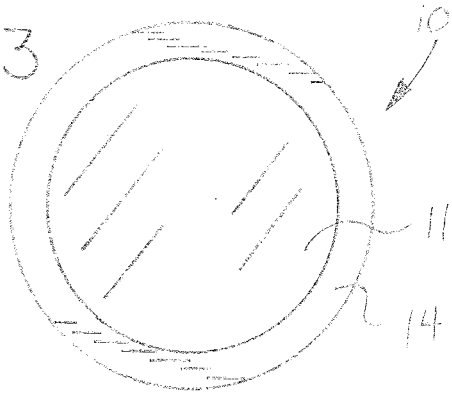
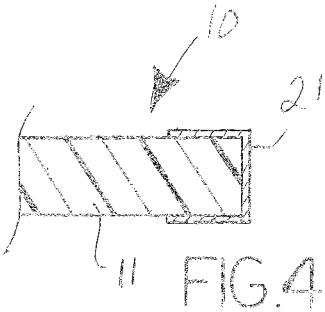
FIG. 4

REINFORCED TRANSPARENT DRAIN SEAL

The benefit of U.S. Provisional Patent Application Ser. No. 61/752,641, filed Jan. 15, 2013, is claimed.

BACKGROUND OF THE INVENTION

This invention relates generally to the field of flat, mat-like seals used to temporarily seal a floor or ground drain to prevent passage of liquid into the drain.

Floor or ground drains are provided in many settings to allow liquids to pass into removal conduits. Often, as in the case for example of storm water drains located along roads and other paved surfaces, the drains empty directly into the storm water system. In the event of hazardous spills, construction run-off or other situations where it is desirable to prevent liquid from entering the drains, it is known to provide sealing mats that are placed atop the drains to block the liquid. The drain seals are typically composed of a flexible, compressible polymer material, such as urethane, having some degree of tackiness and conformability to improve adhesion of the seal to the drain and its surrounding surface. One problem inherent in such known drain seals is that the seals are opaque, and therefore it is impossible to ascertain if the drain has been completely sealed. It is an object of this invention to provide a drain seal that is transparent, such that the efficacy of the seal is readily apparent. It is a further object to provide a transparent drain seal having reinforcing material disposed adjacent the periphery to preclude tearing of the drain seal during use.

SUMMARY OF THE INVENTION

The invention is a mat-like sealing member adapted to temporarily seal a floor or ground drain, the periphery of the drain seal being chosen to extend beyond the periphery of the drain needing to be blocked. The drain seal is composed of a flexible, compressible polymer material having sufficient tackiness to create a seal on the ground or surface surrounding the drain and/or on the drain itself to preclude entry of liquid into the drain. The drain seal comprises at least a large centralized window area that is formed of a transparent material, and further comprises a border or frame adjacent the peripheral areas composed of a reinforcing material, such as a mesh, screen, fabric or the like. Preferably the entire body of the drain seal is transparent and the reinforcing frame is disposed internally within the body.

BRIEF DESCRIPTION OF THE DRAWINGS

FIG. 1 is a top view of an embodiment of the invention.

FIG. 2 is a cross-sectional view of the embodiment of FIG. 1 taken along line 2-2.

FIG. 3 is a top view of an alternative embodiment showing an opaque border surrounding the window area.

FIG. 4 is a partial cross-sectional view of an alternative embodiment showing the reinforcing frame disposed externally on the upper surface, lower surface and edge of the main body.

DETAILED DESCRIPTION OF THE INVENTION

The invention in various embodiments is a mat-like sealing member 10 adapted to temporarily seal a floor or ground drain, the periphery of the drain seal 10 being chosen to extend beyond the periphery of the drain. The term "mat" or its derivatives is taken herein to reference a thin object of little height relative to its length and width dimensions, and composed of material possessing a flexibility or conformability such that the sealing member 10 is not self-standing when stood onto one of its edges. The drain seal 10 may possess a peripheral configuration of any shape, although rectangular, square or circular are likely to be most suitable. The drain seal 10 is composed of a flexible, compressible, conformable polymer material, impermeable to liquids, such as for example polyurethane, and having sufficient tackiness to conform with the ground or surface surrounding the drain and/or the surface of the drain itself to preclude passage of liquid under the seal and into the drain. Typically the drain seal 10 will be less than one inch in thickness, and most typically will be less than one half inch in thickness, and may be many inches in width and length, or diameter, or any other horizontal dimension.

The drain seal 10 comprises a main body 13 having at least a large, centralized window area 11 that is transparent, or at least sufficiently translucent, such that any liquid passing under the drain seal 10 into the drain is visibly noticeable through the main body 13. Preferably, the drain seal 10 further comprises a reinforcing band, border or frame 21 disposed at, near or adjacent the edges 12. The frame 21 is composed of a reinforcing material, such as a mesh, screen, scrim, fabric, fibers or the like which serves to increase durability and resistance to tearing of the drain seal 10 main body 13. The reinforcing frame 21 is most preferably embedded or sandwiched within the interior of the main body 13, as shown in FIG. 2, but may also be provided at or on the upper and/or lower surfaces of the main body 13, and/or on the edges 12 of the main body 13, as shown in FIG. 4.

Preferably the material of composition for the drain seal 10 is entirely transparent such that the location of the reinforcing band 21 defines the window area 11, but it is possible to form the drain seal 10 with an opaque outer periphery 14 surrounding the interior window area 11, with the reinforcing frame 21 disposed within the opaque outer periphery 14 as illustrated in FIG. 3. The transparent window 11 enables the user to visually ascertain that the drain seal 10 has completely sealed the drain and no liquid is entering the drain once the drain seal 10 is put into position.

It is understood that equivalents and substitutions for certain elements and structures set forth above may be obvious to those of skill in the art, and therefore the true scope and definition of the invention is to be as set forth in the following claims.

I claim:

1. A drain seal comprising a main body comprising a window area, whereby with said drain seal positioned on a drain, the drain is visible through said window area;

wherein the window area is translucent;

wherein said entire main body is translucent;

said main body having edges and said drain seal further comprising a reinforcing frame positioned adjacent the edges of the main body;

wherein said reinforcing frame is disposed internally within said main body.

2. The drain seal of claim 1 wherein the window area is transparent.

3. The drain seal of claim 2, wherein said entire main body is transparent.

4. The drain seal of claim 1, said main body comprising an opaque outer periphery surrounding said window area.

5. The drain seal of claim 4, wherein said reinforcing frame is disposed within said opaque outer periphery.

6. A drain seal comprising a main body having a window area, said main body being a mat member having a height less than its length and width, said main body composed of flexible, compressible, conformable polymer material, said window area being at least translucent such that liquid passing under said main body is visible through said main body;

wherein said entire main body is at least translucent such that liquid passing under said main body is visible through said main body;

said main body having edges and said drain seal further comprising a reinforcing frame positioned adjacent the edges of the main body;

wherein said reinforcing frame is disposed internally within said main body.

7. The drain seal of claim 6, said main body comprising an opaque outer periphery surrounding said window area.

8. The drain seal of claim 7, wherein said reinforcing frame is disposed within said opaque outer periphery.

* * * * *